US008678441B2

(12) United States Patent
Kountotsis

(10) Patent No.: US 8,678,441 B2
(45) Date of Patent: Mar. 25, 2014

(54) REMOVABLE OR PEELABLE ARTICLES, ADVERTISEMENTS, AND ILLUSTRATIONS FROM NEWSPAPERS, MAGAZINES AND PUBLICATIONS

(76) Inventor: Theodosios Kountotsis, East Elmhurst, NY (US)

( * ) Notice: Subject to any disclaimer, the term of this patent is extended or adjusted under 35 U.S.C. 154(b) by 283 days.

(21) Appl. No.: 12/924,257

(22) Filed: Sep. 23, 2010

(65) Prior Publication Data

US 2012/0074680 A1 Mar. 29, 2012

(51) Int. Cl.
*B42D 15/00* (2006.01)

(52) U.S. Cl.
USPC ..... 283/56; 283/81; 283/103

(58) Field of Classification Search
USPC ..... 283/56, 81
See application file for complete search history.

(56) References Cited

U.S. PATENT DOCUMENTS 4,734,036 A * 3/1988 Kasha ..... 283/46
5,102,171 A 4/1992 Saetre
5,458,282 A 10/1995 Martin
5,535,536 A * 7/1996 Comann ..... 40/630
5,914,158 A 6/1999 McGuiness
6,273,660 B1 * 8/2001 Ozgen et al. ..... 283/56
6,324,777 B1 12/2001 Ngan
6,416,835 B1 7/2002 Preston et al.
6,520,543 B1 2/2003 Hoar
2002/0119273 A1 8/2002 Napierala, II
2003/0151245 A1 * 8/2003 Levine et al. ..... 283/56
2004/0113418 A1 * 6/2004 Bullen ..... 283/56
2005/0230963 A1 * 10/2005 McDowell et al. ..... 283/81

* cited by examiner

*Primary Examiner* — Kyle Grabowski
(74) *Attorney, Agent, or Firm* — Theodosios Kountotsis

(57) ABSTRACT

A sheet material is presented that has a first layer including first indicia and a second layer including second indicia, the second indicia being (i) the same as the first indicia and (ii) positioned directly over the first indicia. The second indicia of the second layer are removable from the first indicia of the first layer. The first layer is placed on a portion of the sheet material. The first indicia includes at least one of text, images, letters, words, designs, patterns, visual representations, photographs, logos, symbols and advertisements or a combination thereof.

17 Claims, 7 Drawing Sheets

REMOVABLE OR PEELABLE ARTICLES, ADVERTISEMENTS, AND ILLUSTRATIONS FROM NEWSPAPERS, MAGAZINES AND PUBLICATIONS

BACKGROUND

1. Field of the Related Art

The present disclosure relates to paper technology, and more particularly, but not exclusively, to methods and systems for peeling or removing at least articles, advertisements, and/or illustrations from at least newspapers, magazines, and/or publications.

2. Description of the Related Art

Magazines, periodicals, glossies or serials are publications, generally published on a regular schedule, including a variety of articles, generally financed by advertising, by a purchase price, by pre-paid magazine subscriptions, or all three. Magazines may be distributed through the mail and/or through sales by newsstands, bookstores or other vendors and/or through free distribution at selected pick up locations.

In recent years, retail outlets have seen single-copy sales of magazines fall by a few percentage points. The figures are troubling for the magazine industry as the weak economy continues to put a damper on spending and consumers have plenty of free reading options available online. However, newsstand sales are important for publishers because they charge more per copy for single sales than they do with subscriptions. Magazines generally give a discount to those willing to subscribe in order to boost the overall circulation they may promise advertisers. Thus, newsstand sales tend to be driven by the economy and are a timelier indicator of a magazine's vitality than subscriptions, which tend to lag and which are driven by heavy discounting. While newsstand sales are a small percentage of most magazines' circulation, they are a profitable part of it because publishers typically charge only a fraction of the newsstand price for a subscription copy.

Although the Internet has been taking more of people's time for years, overall magazine circulation had been holding steady for a while. Thus, it is difficult to say how much of the decline is the result of consumers abandoning an old medium for the Internet and how much results from the recession hitting people's budgets. In order to increase sales, publishers have devised new strategies. For example, one successful strategy is publisher funded promotions (e.g., discounts off future magazine purchases) that have the potential to increase magazine sales considerably. For instance, in 2009, a joint newsstand promotion by Magazine Publishers of America™ (MPA) and wholesale distributor Harrisburg News™ led to a 15% rise in magazine category sales and a 25% increase in sales of 9 titles that received special display support. This publisher-funded promotion brought additional attention to the magazine category at retail, and enhanced the revenue and profitability of single copy magazine sales for retailers and channel partners.

However, more strategies need to be envisioned for positively altering the magazine, newspaper, and/or publication reading experience. For instance, almost every reader of magazines or newspapers or any other type of publications has wanted to remove and save an interesting article or advertisement or illustration or any other type of indicia on the publication. Many readers wish to keep clippings related to various categories of interest and save them for future reference and/or use. Most readers resort to ripping out the entire page of the publication or using a scissor to cut out select portions of the publication. Many readers do so by accidentally damaging the article of interest. As a result, it would be advantageous to be able to quickly and efficiently remove at least articles or advertisements or illustrations of interest without ruining or damaging or significantly altering the original publication, as well as the desired information to be removed.

In conclusion, the magazine industry is far from dead. However, it could use a few boosts of creativity by providing novel features or options that are deemed worthwhile by consumers. Therefore, there is a need for creative solutions to keep the magazine and newspaper industries thriving even in sluggish economic times. Thus, there is a need in the paper art for a technological solution that overcomes at least in part the aforesaid deficiencies.

SUMMARY

The present disclosure provides a sheet material having a first layer including first indicia and a second layer including second indicia, the second indicia being (i) the same as the first indicia and (ii) positioned directly over the first indicia; wherein the second indicia of the second layer are removable from the first indicia of the first layer.

The present disclosure further provides a sheet material having a first surface including first indicia and a plurality of second surfaces each positioned directly on the first surface and each including second indicia, the plurality of second surfaces being selectively and individually removable with respect to the first surface; wherein the first indicia are the same as the second indicia of each of the plurality of second surfaces.

The present disclosure also provides a method of manufacturing a sheet material, the method including the steps of forming a first layer including first indicia; and forming a second layer including second indicia, the second indicia being (i) the same as the first indicia and (ii) positioned directly over the first indicia; wherein the second indicia of the second layer are removable from the first indicia of the first layer.

The present disclosure also provides a method of manipulating electronic documents, including a processor; a computer-readable storage medium in communication with the processor, the computer-readable storage medium comprising one or more programming instructions for: tagging one or more layers or information of interest and redirecting the tagged one or more layers or information of interest to a document.

Further scope of applicability of the present disclosure will become apparent from the detailed description given hereinafter. However, it should be understood that the detailed description and specific examples, while indicating preferred embodiments of the present disclosure, are given by way of illustration only, since various changes and modifications within the spirit and scope of the present disclosure will become apparent to those skilled in the art from this detailed description.

BRIEF DESCRIPTION OF THE DRAWINGS

Various embodiments of the present disclosure will be described herein below with reference to the figures wherein.

Figure 1:
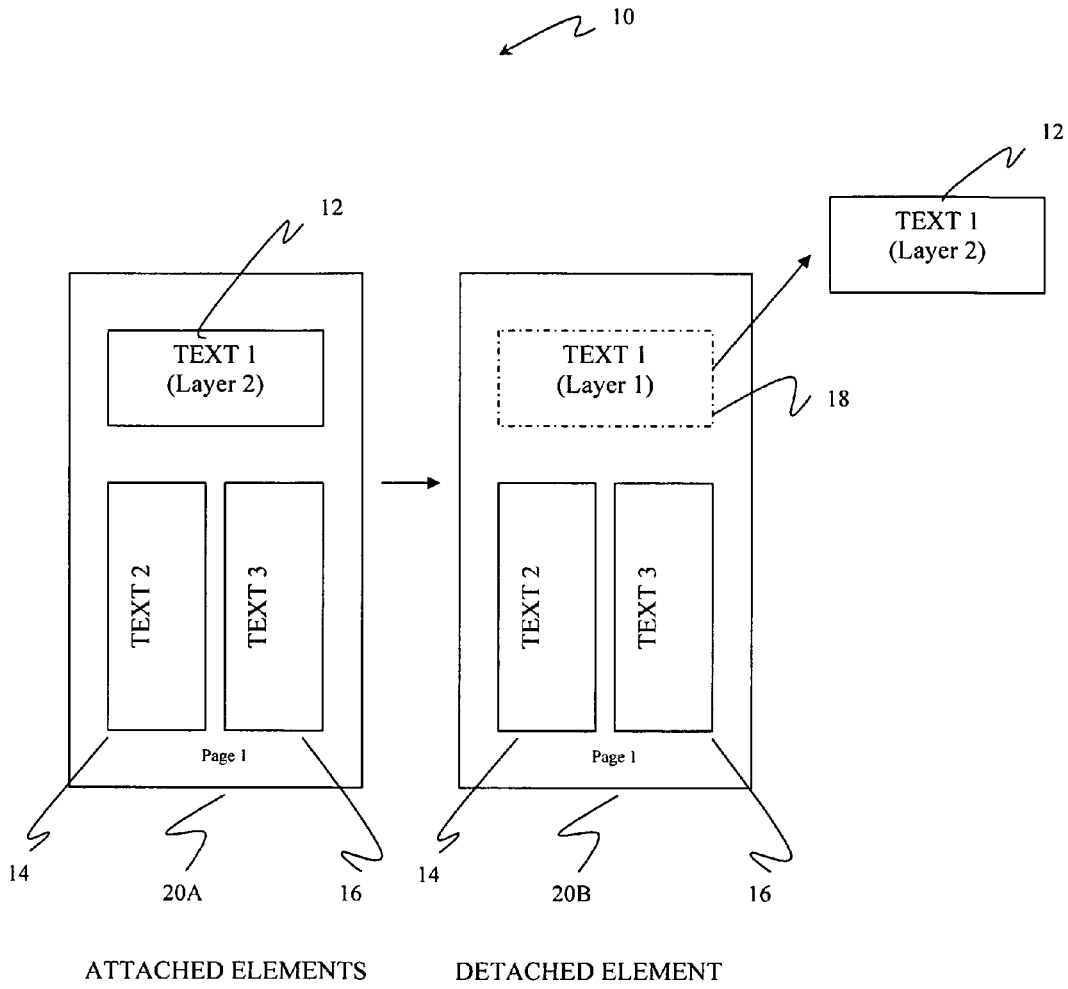
FIG. 1 illustrates a page of a magazine that allows a user to selectively remove one or more portions/segments from the page, without ruining or altering the original version of the magazine, in accordance with the present disclosure.

It is noted that the drawings of the present disclosure are not to scale. The drawings are intended to depict only typical embodiments of the present disclosure, and therefore should not be considered as limiting the scope of the present disclosure. In the drawings, like numbering represents like elements between the drawings.

DETAILED DESCRIPTION

Although the present disclosure will be described in terms of a specific embodiment, it will be readily apparent to those skilled in this art that various modifications, rearrangements and substitutions may be made without departing from the spirit of the present disclosure. The scope of the present disclosure is defined by the claims appended hereto.

For the purposes of promoting an understanding of the principles of the present disclosure, reference will now be made to the exemplary embodiments illustrated in the drawings, and specific language will be used to describe the same. It will nevertheless be understood that no limitation of the scope of the present disclosure is thereby intended. Any alterations and further modifications of the inventive features illustrated herein, and any additional applications of the principles of the present disclosure as illustrated herein, which would occur to one skilled in the relevant art and having possession of this disclosure, are to be considered within the scope of the present disclosure.

Reference throughout this specification to "one embodiment," "an embodiment," or similar language means that a particular feature, structure, or characteristic described in connection with the embodiment is included in at least one embodiment of the present disclosure. Thus, appearances of the phrases "one embodiment," "an embodiment," and similar language throughout this specification may, but do not necessarily, all refer to the same embodiment, different embodiments, or component parts of the same or different illustrated disclosure. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the present disclosure as claimed. The independent embodiments are considered to be able to be combined in whole or in part one with another as the claims and/or art may direct, either directly or indirectly, implicitly or explicitly.

Moreover, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

Prior to describing the present disclosure in further detail, it will first be helpful to define various terms that will be used throughout the following discussion. For example:

In this application, the use of the singular includes the plural unless specifically stated otherwise. In this application, the use of "or" means "and/or" unless stated otherwise. Furthermore, the use of the term "including," as well as other forms, such as "includes" and "included," is not limiting.

The term "sheet material" may be defined at least as a rectangular piece of paper or parchment. The term "sheet material" may refer to at least a newspaper or magazine or periodical or publication. The term "sheet material" may be synonymous or equivalent with at least: paper, newspaper, newsletter, daily, gazette, journal, article, essay, report, note, stationary, letter, document, brochure, leaflet, clippings, excerpts, pamphlets, writings or any material on which writings or indicia may be included thereon. The term "sheet material" may be used interchangeable with the term "publication." A "publication" may refer to at least a printed writing or visual material. A "publication" may also refer to a book.

The term "indicia" may be defined at least as a marking or indication or writing. The term "indicia" may be defined at least as distinguishing markings or signs or indications. The term "indicia" may be synonymous or equivalent with at least: text, images, letters, words, designs, patterns, visual representations, photographs, logos, advertisements, and symbols or a combination thereof.

The term "layer" may be defined at least as a cover, a covering, a film, a lamination, or any type of material that may include indicia, as defined above.

The term "adhesive member" may refer at least to a gel, a viscous substance, a gelatin or gelatinous substance, a sticky substance, a gooey substance, a waxy substance, a gel tape and/or a bonding substance. The term "adhesive member" may refer to any type of substance that retains "layers of indicia," as defined above, on "sheet material," as defined above. The "adhesive member" may be any type of device, apparatus, unit, module, configuration, mechanism, instrument, and/or structure for receiving and adhering/attaching the layers including the indicia thereon to sheet material.

The term "storage" may at least refer to data storage. "Data storage" may refer to at least any article or material (e.g., a hard disk) from which information may be capable of being reproduced, with or without the aid of any other article or device. "Data storage" may refer to at least the holding of data in an electromagnetic form for access by a computer processor. Primary storage may be data in random access memory (RAM) and other "built-in" devices. Secondary storage may be data on hard disk, tapes, and other external devices. "Data storage" may also refer to the permanent holding place for digital data, until purposely erased. "Storage" implies a repository that retains its content without power. "Storage" mostly means magnetic disks, magnetic tapes and optical discs (CD, DVD, etc.). "Storage" may also refer to non-volatile memory chips such as flash, Read-Only memory (ROM) and/or Electrically Erasable Programmable Read-Only Memory (EEPROM).

The term "electronic device" may refer at least to one or more personal computers (PCs), a standalone printer, a standalone scanner, a mobile phone, an MP3 player, audio electronics, video electronics, GPS systems, televisions, recording and/or reproducing media (such as CDs, DVDs, camcorders, cameras, etc.) or any other type of consumer or non-consumer analog and/or digital electronics. Such consumer and/or non-consumer electronics may apply at least in any type of entertainment, communications, home, and/or office capacity. Thus, the term "electronic device" may refer to at least any type of electronics suitable for use with a circuit board and intended to be used by a plurality of individuals for a variety of purposes. The electronic device may be any type of computing and/or processing device.

In one exemplary embodiment, the present disclosure proposes a system and method of peeling or removing data/information/indicia from one or more publications so that the one or more publications remain intact. Articles may be selectively removed from one or more publications without affecting the original content of the one or more publications. For example, articles in the one or more publications may be in duplicate format. The duplicate data/information/indicia may be positioned directly over each other in a non-discernable manner (overlapping manner). The data/information/indicia may be positioned on one page of a publication or on multiple pages of a publication or on all the pages of a publication. Each sheet of paper or sheet material may include several removable layers or segments or bits or pieces or portions or sections or sectors of information or data or indicia. The layers may comprise or encompass a portion of the sheet of paper or the entire sheet of paper.

In another exemplary embodiment, the layers attached to the sheet material may be constructed from at least vinyl, vinyl-film, adhesive coated film, reflective sheeting, magnetic sheeting, tape technologies, decal transfer technologies, inkjet decals, removable vinyl decal stickers, waterproof sticker sheets and/or removable/reusable vinyl materials or a combination thereof. Additionally, the layers attached to the sheet material may be removable stickers or removable labels or static-cling vinyl materials/products. The layers attached to the sheet material may have at least a high-gloss finish, perforated edges, perforated perimeters or circumference, be transparent and manufactured in a variety of different cut-out shapes in accordance with publishers' requirements.

The present disclosure further proposes systems and methods related to removable/peelable articles, removable/peelable data or information or indicia, publications with removable/peelable layers, removable flat inserts positioned directly over data, and inserts positioned directly over existing data that are the same as the data below. The present disclosure further proposes systems and methods related to information-to-go, data-to-go, articles-to-go, advertisements-to-go, indicia-to-go, portable data or information or sections/segments of information from a plurality of publications, static cling magazines, and/or static cling newspapers.

The present disclosure further proposes systems and methods where multiple layers are incorporated within/onto or embedded within/onto the sheet material. The sheet material is constructed to include a plurality of segments, each segment including identical indicia, such that the segments, in aggregate, do not encompass the entire surface of the sheet material. The multiple layers are overlapping identical indicia. The multiple layers may statically cling to each other so that only the top layer is discernable to a subject.

The present disclosure further proposes a method of manufacturing a publication. The method of manufacturing includes positioning or placing several layers of the same/identical information/indicia embedded within or incorporated thereon or directly on at least portions of sheets of paper and binding such paper to form a publication, such as, for example, a magazine or newspaper.

The present disclosure may further refer to a method of transferring at least electronic articles/advertisements/illustrations or any type of information from a webpage to a document used for storing such electronic clippings. This may be referred to as a tag and drag method for selectively tagging a plurality of information from a plurality of websites and organizing such information into a single document or file.

Reference will now be made in detail to embodiments of the present disclosure. While certain embodiments of the present disclosure will be described, it will be understood that it is not intended to limit the embodiments of the present disclosure to those described embodiments. To the contrary, reference to embodiments of the present disclosure is intended to cover alternatives, modifications, and equivalents as may be included within the spirit and scope of the embodiments of the present disclosure as defined by the appended claims.

Embodiments will be described below while referencing the accompanying figures. The accompanying figures are merely examples and are not intended to limit the scope of the present disclosure.

With reference to FIG. 1, there is presented a page of a magazine that allows a user to selectively remove/peel one or more portions/segments from the page, without altering the page or content on the page, in accordance with the present disclosure.

The diagram 10 depicts an original page 20A having first text 12, second text 14, and third text 16. The page 20A may be part of any type of publication, such as, for example, a magazine or newspaper. The first, second, and, third texts 12, 14, 16 may be, for example, articles written for the publication.

The diagram 10 also depicts a modified page 20B having first layer text 18, second text 14 and third text 16. The second layer text 12 has been removed or peeled off by a user.

An example is presented to clarify how FIG. 1 works. For instance, a user picks up a magazine. The user turns to page 1 and reads three articles (or texts 12, 14, 16) presented on page 1. The user is very interested in article 1 and wishes to have or take that article. The user may wish to have such article for future reference or to give it to someone to read or for any other reason. In the instant case, and in accordance with the exemplary embodiments, the user may peel or remove article 1 from original page 20A. Article 1 may be positioned or attached to original page 20A via static cling. Once the user removes article 1 from original page 20A, the text of article 1 remains on modified page 20B. The reason for this is that the publisher of the magazine printed, for example, article 1 twice on separate layers, the separate layers positioned directly on top of each other in a non-discernable manner (in an overlapping manner). Of course, it is contemplated that several copies of article 1 may be positioned over each other in the designated spot on page 1. Therefore, multiple readers may remove article 1 from the same magazine or newspaper or publication.

Thus, the information (e.g., article 1) is the same or identical or indistinguishable or carbon copies of each other in predetermined designated spot/locations of the sheet material. Thus, one single sheet material includes at least one set of indicia, the set of indicia being at least duplicated over each other on predesignated portions on the same sheet material. As a result, a reader need not rip out the entire page 1 or use a scissor to clip article 1 from page 1. Instead, a reader may simply, easily, and quickly remove article 1 from page 1 without damaging or even altering the magazine or newspaper or publication, thus simultaneously keeping the magazine intact in its original state because even though one copy of article 1 has been removed/peeled off, at least one more copy of article 1 is positioned directly beneath the removed/peeled off article 1 in the same designated spot/location. It is contemplated that the magazine has the original article (non-peelable format) no matter how many layers of the article (peelable format) are placed on top of the original article. Thus, the original version of the magazine with all the articles remains intact.

FIG. 1 illustrates two copies of article 1, the two copies positioned over each other on original page 20A. On original page 20A, the second layer or second copy of article 1 is only seen by a reader because the first copy of article 1 is placed directly beneath the second copy. On modified page 20B, the user has removed the second layer or second copy of article 1 such that the first layer or first copy of article 1 is revealed to the reader. The first layer of article 1 is depicted as a phantom line in FIG. 1.

As illustrated in FIG. 1, a layer is placed on a portion of a sheet material. Thus, several different layers of information may be placed on a sheet material. However, it is contemplated that one layer may overlay or encompass the entire sheet material.

As illustrated in FIG. 1, information or indicia is placed on a layer. The indicia may include, but are not limited to, at least one of the following items: text, images, letters, words, designs, patterns, visual representations, photographs, logos, symbols, and advertisements or a combination thereof.

One exemplary method of attaching layer 2 to layer 1 may be via static cling technology. For instance, static cling vinyl is a special formulation of polyvinyl chloride (PVC) to which a large amount of plasticizer (a liquid) has been added. This highly plasticized formulation is exceptionally pliable. The vinyl is calendered to give it a smooth finish. When the vinyl film is applied to a clean, smooth, glossy surface, it adheres firmly without the need for an adhesive. Because there is no adhesive, application or installation is very easy. It may be removed and re-applied nearly indefinitely without leaving behind an adhesive residue. Thus, one advantage or preferable characteristic of the layers described herein is that they may be easily removed without damaging or altering the surface of the publication (i.e., removable, reusable, transparent vinyl sheets). It is contemplated that there is no sticky residue and no picking at the layers for several minutes with a razor blade. However, one skilled in the art may contemplate a myriad of different ways to attach/adhere multiple layers on top of each other, in predesignated spots/locations of a sheet material, without damaging or inadvertently altering the original publication, including the use of magnetic attachment mechanisms.

Additionally, as illustrated in FIG. 1, the entire rear surface of the second layer may include an adhesive material. However, it is contemplated that only a portion of the rear surface of the second layer may include an adhesive material. Moreover, one or more different adhesives may be simultaneously used to attach the second layer to the first layer and the second layer to an external surface after removal from the first layer.

Figure 2:
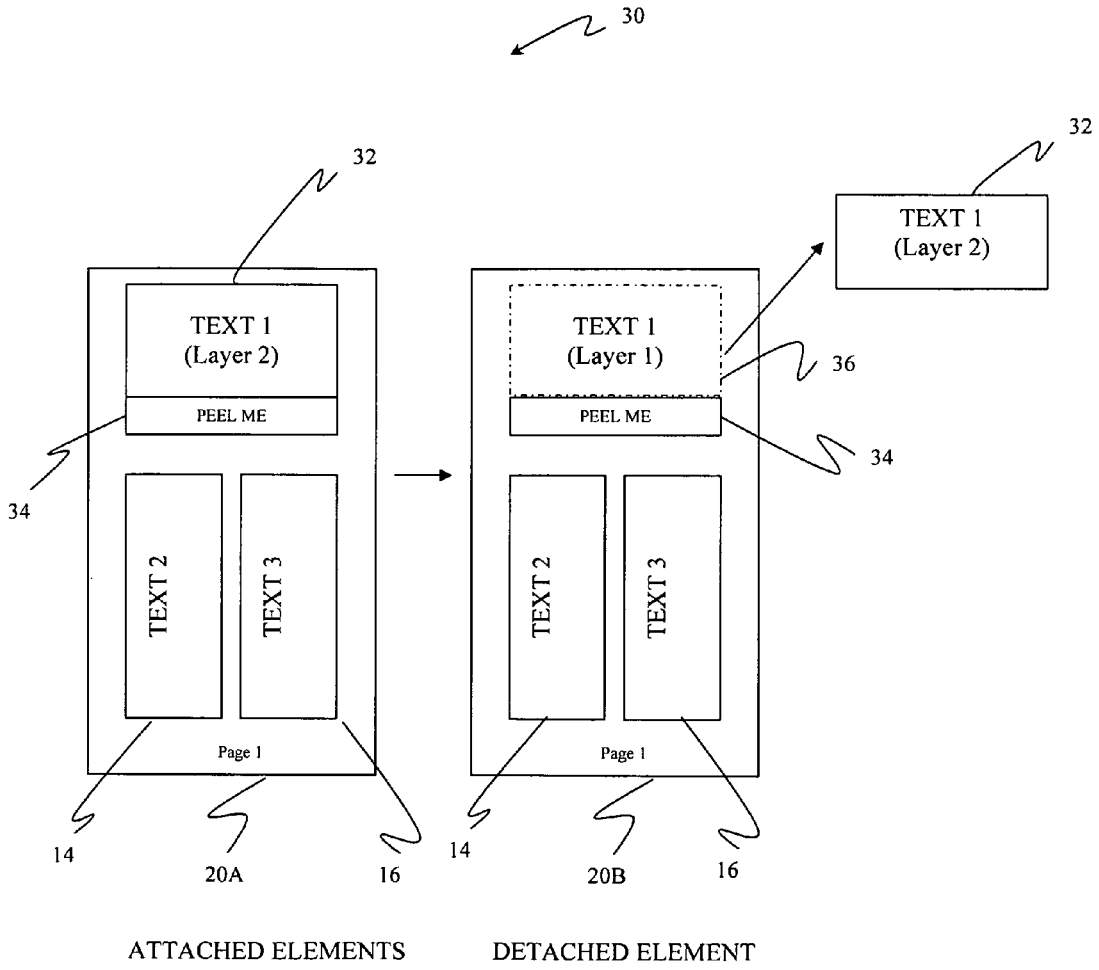
FIG. 2 illustrates a page of a magazine that allows a user to selectively remove one or more portions/segments having additional information thereon, the additional information remaining intact, in accordance with the present disclosure.

With reference to FIG. 2, there is presented a page of a magazine that allows a user to selectively remove/peel one or more portions/segments having additional information thereon, in accordance with the present disclosure.

The diagram 30 is similar to the diagram 10 of FIG. 1. Therefore, similar elements to FIG. 1 will not be described in detail. In contrast to FIG. 1, FIG. 2 includes a non-removable portion 34.

The diagram 30 depicts first text 32. First text 32 includes non-removable portion 34. The non-removable portion 34 may be any type of informative information. For instance, it may include designations such as, but not limited to, "TAKE ME," "REMOVE ME," "RIP ME," "PEELABLE ARTICLE," "PEEL ME," and/or "TAKE ONE." A publisher may contemplate using a plurality of different information to convey to a reader to remove the article or may include any other type of additional information to be conveyed to a reader. Therefore, the second indicia of the second layer 32 may include an additional portion 34 not overlapping the first indicia of the first layer 36.

In operation, similarly to FIG. 1, in FIG. 2, the two copies are positioned over each other on original page 20A. On original page 20A, the second layer 32 or second copy of article 1 is only seen by a reader because the first copy 36 of article 1 is placed directly beneath the second copy 32 (in an overlapping manner). On modified page 20B, the user has removed the second layer 32 or second copy of article 1 such that the first layer 36 or first copy of article 1 is revealed to the reader. The first layer 36 of article 1 is depicted as a phantom line in FIG. 2. Moreover, the non-removable portion 34 of text remains on the original and modified pages 20A, 20B. Of course, one skilled in the art may contemplate using a plurality of different non-removable portions presented in a plurality of different shapes and sizes. For instance, a single non-removable portion may envelop or surround the article or one or more non-removable portions may be incorporated within the article.

Figure 3A:
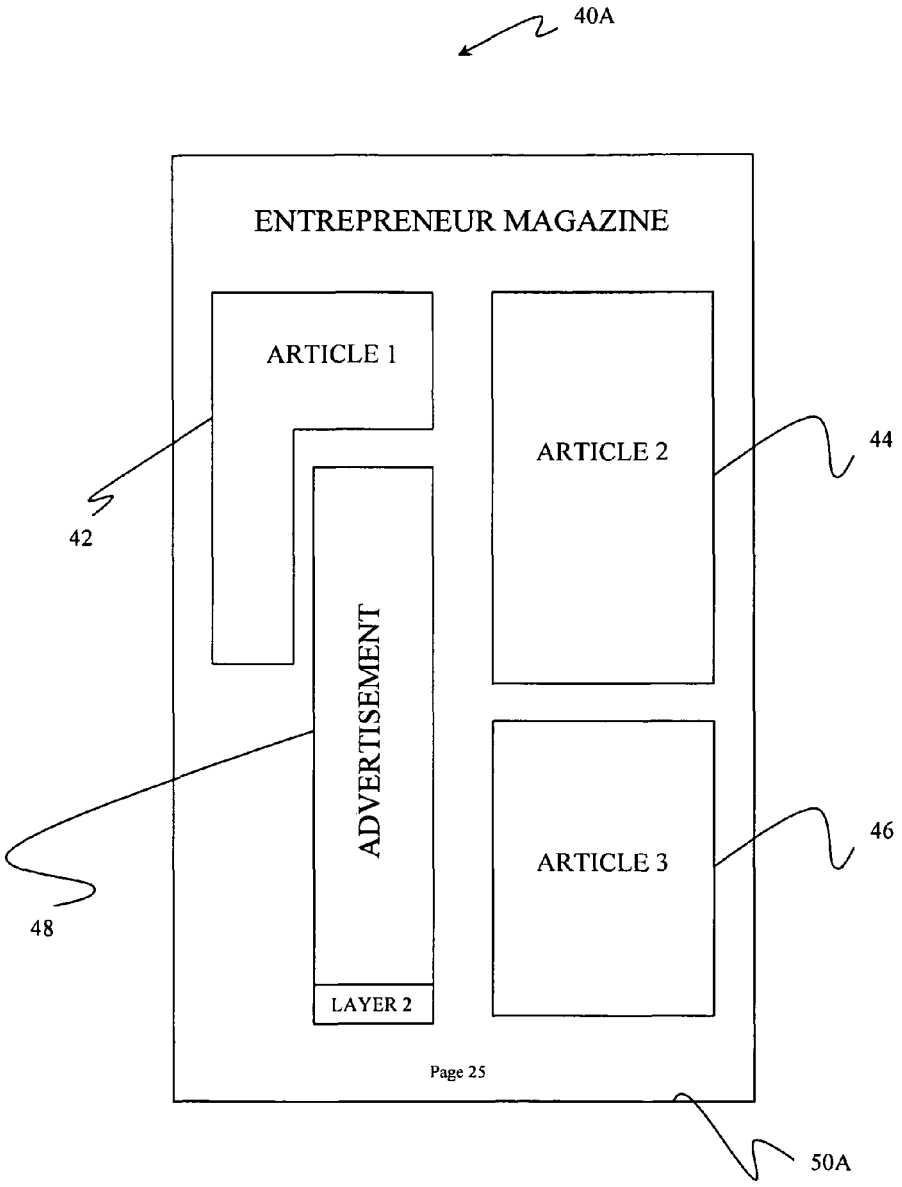
FIG. 3A illustrates a page from a first magazine having a plurality of articles and an advertisement in a first configuration, in accordance with the present disclosure.
Figure 3B:
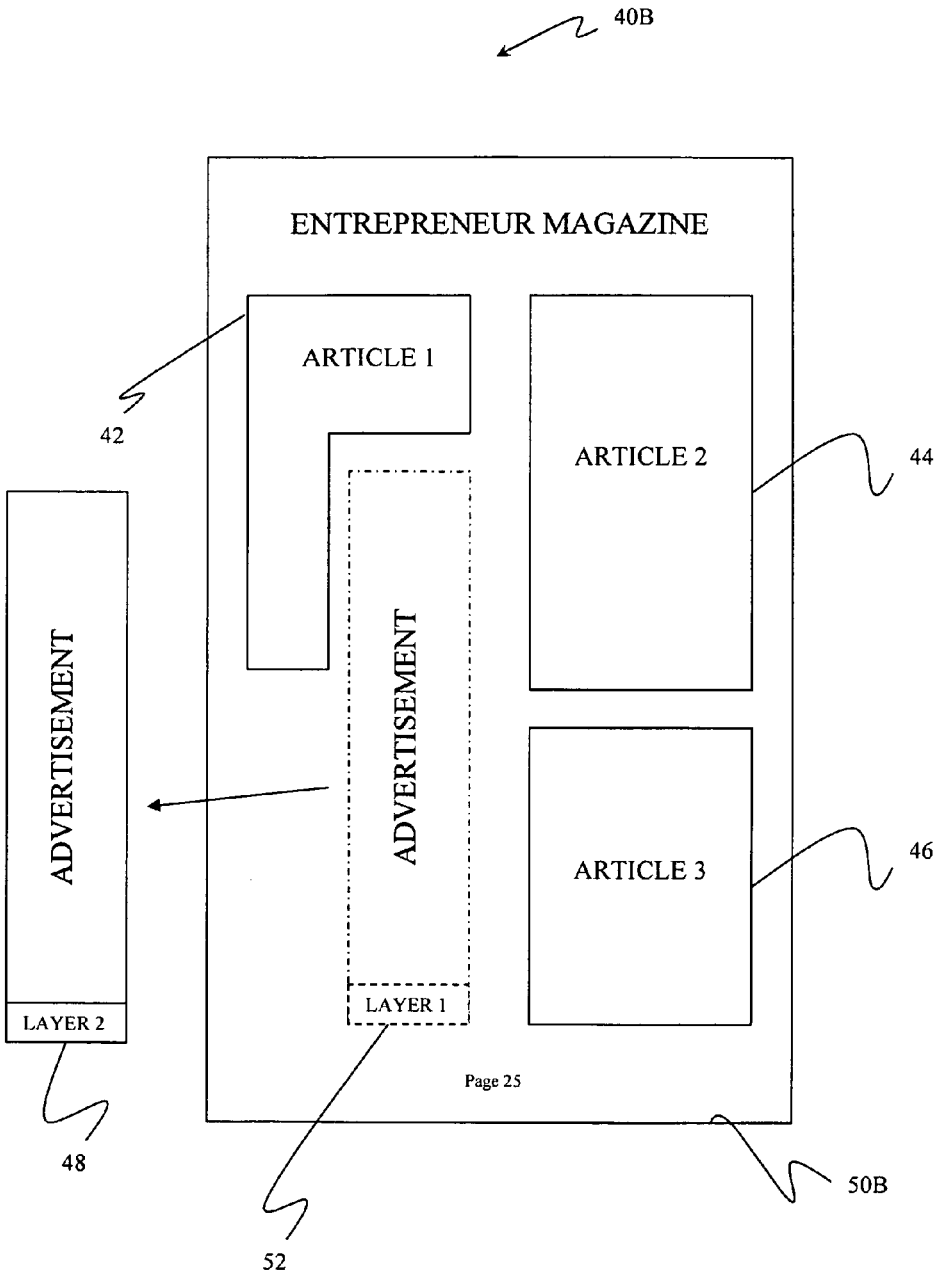
FIG. 3B illustrates the page from the first magazine having the plurality of articles and the advertisement in a second configuration, where the advertisement is removed without damaging or altering the first magazine, in accordance with the present disclosure.

With reference to FIG. 3A, there is presented a page from a first magazine having a plurality of articles and an advertisement in a first configuration, in accordance with the present disclosure. With reference to FIG. 3B, there is presented the page from the first magazine having the plurality of articles and the advertisement in a second configuration, where the advertisement is removed, in accordance with the present disclosure.

Regarding FIG. 3A, diagram 40A shows an original sheet 50A being page 25 of Entrepreneur™ magazine, which may include a first article 42, a second article 44, a third article 46, and an advertisement 48. A reader browsing through this page of the magazine may be interested in advertisement 48. In the instant case, 2 layers of the advertisement are incorporated into or embedded onto page 25 of the magazine. Initially, only layer 2 of advertisement 48 is visible to the reader. It is noted that after the two removable layers are removed or peeled off by a reader, the original article still remains intact, since a non-peelable version of the article is positioned as the bottom-most layer. Therefore, the original content remains with the magazine, thus keeping the magazine intact in its original version.

Regarding FIG. 3B, diagram 40B shows a modified sheet 50B being page 25 of Entrepreneur™ magazine. The layer 2 advertisement 48 has been removed and layer 1 advertisement 52 is revealed to the reader. The layer 2 advertisement 48 may be freely and easily taken from the magazine, without damaging or altering the content of the magazine.

As a result, in accordance with the exemplary embodiments of the present disclosure, readers of publications may remove/peel off information (e.g., articles, illustrations, advertisements, etc.) that appeal to the reader so that the reader may use such information for future reference or provide such information to another interested party. Additionally, the removal of such information from the publication does not damage or even alter the publication because the information removed is provided in multiple copies (as well as an original non-peelable copy at the bottom-most level). Therefore, the information/indicia always remain intact because the information/indicia are not permanently removed from the magazine. An original print of the original indicia always remains with the publication.

Figure 4A:
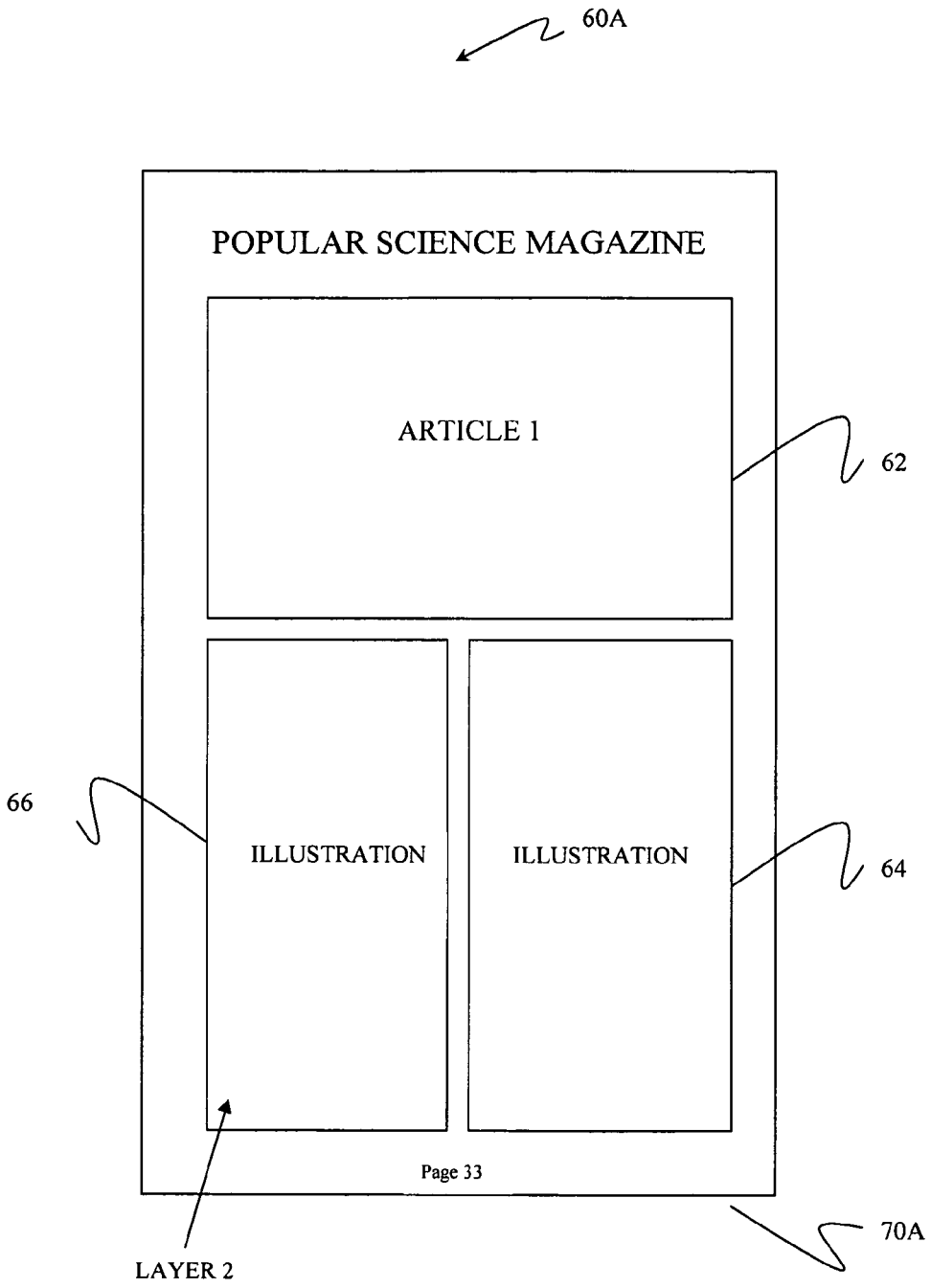
FIG. 4A illustrates a page from a second magazine having an article and two illustrations in a first configuration, in accordance with the present disclosure.
Figure 4B:
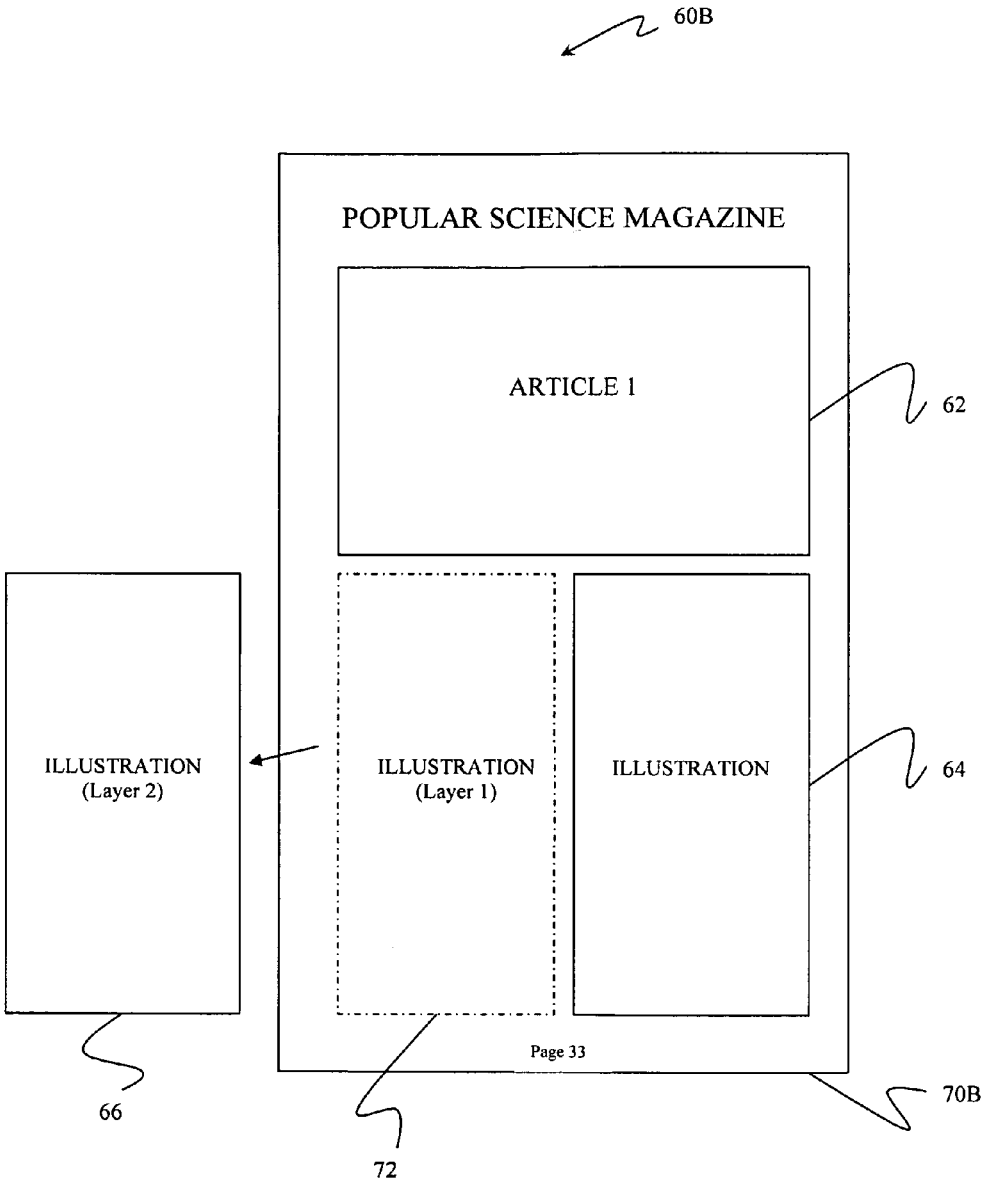
FIG. 4B illustrates the page from the second magazine having the article and the two illustrations in a second configuration, where one illustration is removed without damaging or altering the second magazine, in accordance with the present disclosure.

With reference to FIG. 4A, there is presented a page from a second magazine having an article and two illustrations in a first configuration, in accordance with the present disclosure. With reference to FIG. 4B, there is presented the page from the second magazine having the article and the two illustrations in a second configuration, where one illustration is removed, in accordance with the present disclosure.

Regarding FIG. 4A, diagram 60A shows an original sheet 70A being page 33 of Popular Science™ magazine, which may include a first article 62, a first illustration 64, and a second illustration 66. A reader browsing through this page of the magazine may be interested in second illustration 66. In the instant case, and in accordance with the exemplary embodiments of the present disclosure, 2 layers of the illustration are incorporated into or onto page 33 of the magazine. Initially, only layer 2 of second illustration 66 is visible to the reader. It is noted that after the two removable layers are removed or peeled off by a reader, the original article still remains intact, since a non-peelable version of the article is positioned as the bottom-most layer. Therefore, the original content remains with the magazine, thus keeping the magazine intact in its original version.

Regarding FIG. 4B, diagram 60B shows a modified sheet 70B being page 33 of Popular Science™ magazine. The layer 2 illustration 66 has been removed and layer 1 illustration 72 is revealed to the reader. The layer 2 illustration 66 may be freely and easily taken from the magazine, without damaging or altering the magazine.

As a result, in accordance with the exemplary embodiments of the present disclosure, readers of publications may remove/peel off information (e.g., articles, illustrations, advertisements, etc.) that appeal to the reader so that the reader may use such information for future reference or provide such information to another interested party. Additionally, the removal of such information from the publication does not damage or even alter the publication because the information removed is provided in multiple copies (as well as an original non-peelable copy at the bottom-most level). Therefore, the information/indicia always remain intact because the information/indicia are not permanently removed from the magazine. An original print of the original indicia always remains with the publication.

Thus, as described above with reference to FIGS. 1-4B, a third layer, being a non-peelable layer is placed as the bottom-most layer with respect to all the other removable or peelable layers. The third layer would include the same or identical indicia as all the other removable or peelable layers and would serve to keep the original content of the publication intact, in order to keep the entire publication intact (e.g., in its original state as bought from the newsstand, retail outlet or as mailed to a reader as a subscription).

Figure 5:
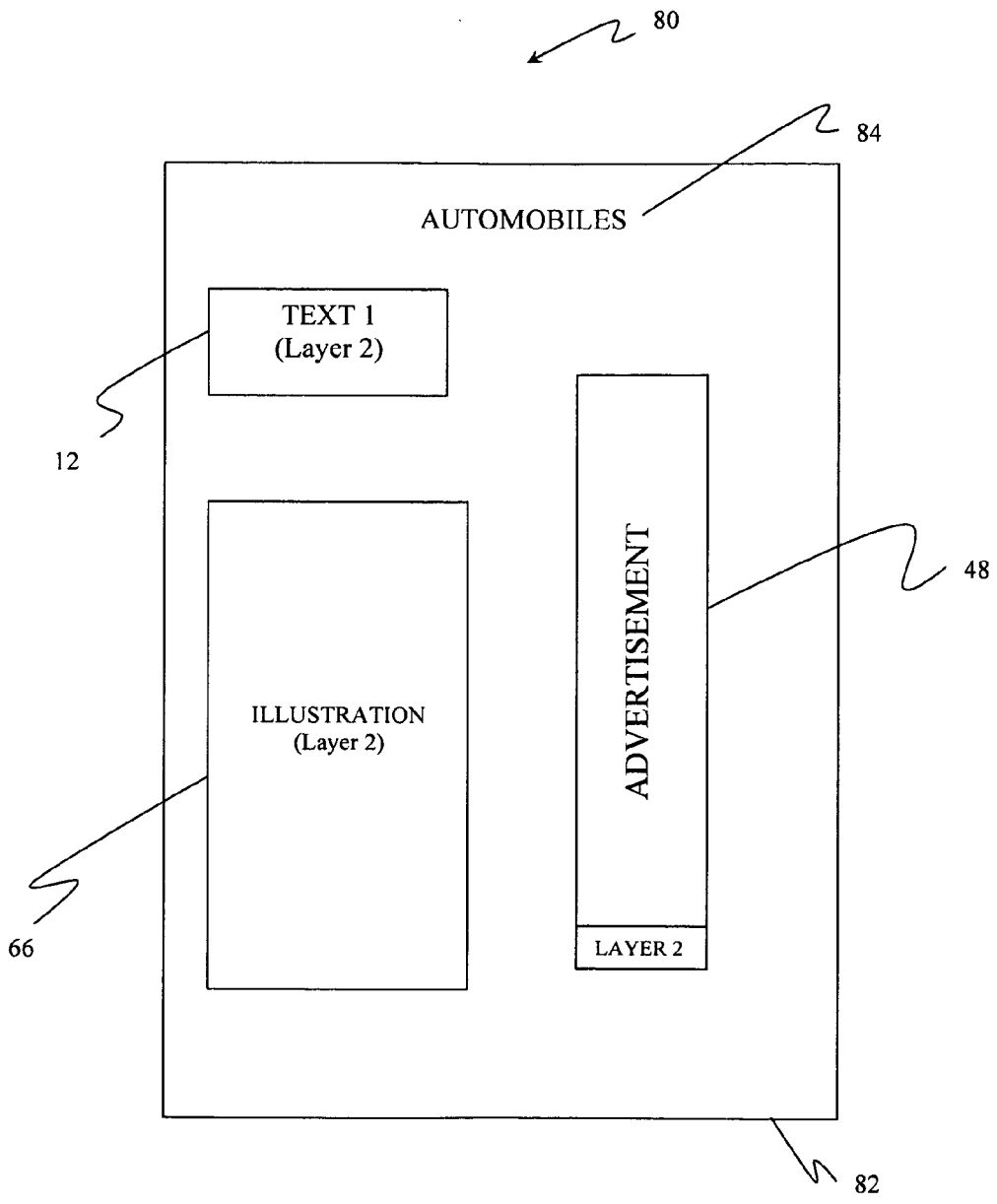
FIG. 5 illustrates a collector page that allows a user to insert or attach at least the articles, advertisements, illustrations removed from all the magazines and/or newspapers and/or publications, in accordance with the present disclosure.

With reference to FIG. 5, a collector page that allows a user to insert or attach the articles, advertisements, illustrations removed from all magazines and/or newspapers and/or publications, in accordance with the present disclosure is presented.

Diagram 80 illustrates sheet 82. Sheet 82 may be a collector sheet for receiving all the removable information collected or assembled by a user or reader. For example, the first text 12 from FIG. 1 (e.g., a NY Times™ article), the advertisement 48 from FIG. 3B, and the second illustration 66 from FIG. 4B may be positioned on sheet 82. Sheet 82 may have a title 84 called "AUTOMOBILES."

For example, the NY Times™ article 12 may be related to an analysis of Ford Motors™ new electric car technology, the advertisement 48 may be related a new model for a Ford Motors™ electric car to be release this upcoming year shown in Entrepreneur™ Magazine, and the second illustration 66 may be related to pictures of automobile interiors of competing electric cars in Popular Science™ Magazine. As such, in accordance with the exemplary embodiments of the present disclosure, a user may be able to easily collect or assemble, for example, automobile related information (e.g., articles, illustrations, advertisements, etc.) from a plurality of magazines, by leaving the original version on the magazines intact, and by attaching all such information/data/indicia on a common sheet or book or file for future reference and/or use.

Moreover, in yet another non-limiting example, a reader or user may have an interest in cooking. The reader or user may subscribe to multiple cooking magazines. The reader may find a cheesecake recipe of interest in Bon Appétit™ magazine and peel it off The reader may then look through Cook's Illustrated™ magazine and come across pictures of ready made chicken dishes. The reader may peel off all the chicken dish illustrations of interest. The reader may then look through Food and Wine™ magazine and find a list of red wines that pair well with the cheesecake recipe of interest in the Bon Appetit™ magazine. The reader may peel off such list. The reader may also browse through an old Cooking Light™ magazine at the dentist's office, while waiting for a cleaning, and find an advertisement for a slow cooker of interest for cooking the chicken dishes found in Cook's Illustrated™ magazine. The reader may peel off such advertisement from the magazine found in the dentist's office. The reader may then assemble all such information/indicia and insert or attach them into or onto a single document or file, such as a book constructed to receive, for instance, removable static cling information/data/indicia. Thus, all of this collected information/data/indicia may be organized by category in a single area for east future reference.

Moreover, in yet another non-limiting example, a book may include one or more layers of multiple, yet similar or identical data to be removed by a user. For example, a user enters a bookstore and browses through books. A user identifies a book of interest and reads a synopsis provided on the back of the book. The text of the synopsis on the back of the book may include a plurality of layers, each layer positioned or placed directly over the other in a non-discernable manner, such that a user may peel off/remove a layer and take it with him/her. Thus, a user may take the synopsis and make it portable document to show to others or to keep for future reference. Of course, the removable layer need not only be the synopsis. A publisher may select any type of information to be removable or peelable from the book. For instance, the information may relate to a list of other books written by the same author or other recommended books by the same publisher. The information may further relate to instant discount codes for this book or other products purchased in conjunction with this book. The instant discount codes may be activated by a separate barcode placed on each removable layer, as discussed below with reference to an alternative embodiment of the present disclosure.

Of course, a multitude of different scenarios may be contemplated for collecting a plurality of different information/ data/indicia from a plurality of different publications, such as magazines, newspapers, brochures, books, etc. and organized into a single document/file.

In an alternative embodiment of the present disclosure, the concepts of removing information from paper products may conceivably be applied to electronic information as well. For example, a user may browse several websites on the Internet. A user may come across an article of interest from a first website, an illustration on a second website, and an advertisement on a third website. A user may click or tag and drag the items of interest from the plurality of websites onto a common document. Of course any type of electronic device, as defined herein, may be used, and any type of data storage, as defined herein, may be implemented. Additionally, based on the electronic information tagged and dragged, the electronic information of interest may be recorded and categorized into historical or statistical data in order to allow manipulators (e.g., advertisers or marketers or sellers (of publications), etc.) to determine what messages to display on their websites in the future, based on the collected historical or statistical data.

In yet another an alternative embodiment of the present disclosure, barcodes may be placed on each removable or peelable layer. The barcodes may be associated with discounts or sales offered by the magazine or the entity described in the article or advertisement. The barcodes may be associated with any type of entity. For example, with the company selling the book (e.g., Barnes & Noble™, Borders™, etc.) or associated with the publisher (e.g., Random House™, Pearson™, Hachette™, Harper Collins™, etc.) or associated with any type of advertiser for any type of product. The peelable portion having the barcode may be scanned at any cash/credit register of any store for redemption.

It will be understood that there are to be no limitations as to the dimensions and shape of the layers positioned on the sheet materials or the materials from which the layers and sheet materials are manufactured or the electronics that may be used to run such a system if implemented in an electronic manner via an electronic device.

The foregoing examples have been provided merely for the purpose of explanation and are in no way to be construed as limiting of the present method and system disclosed herein. While the present disclosure has been described with reference to various embodiments, it is understood that the words, which have been used herein, are words of description and illustration, rather than words of limitations. Further, although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims. Those skilled in the art, having the benefit of the teachings of this specification, may effect numerous modifications thereto and changes may be made without departing from the scope and spirit of the present disclosure in its aspects.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

Having described the present disclosure above, various modifications of the techniques, procedures, material and equipment will be apparent to those in the art. It is intended that all such variations within the scope and spirit of the appended claims be embraced thereby.

The foregoing examples illustrate various aspects of the present disclosure and practice of the methods of the present disclosure. The examples are not intended to provide an exhaustive description of the many different embodiments of the present disclosure. Thus, although the foregoing present disclosure has been described in some detail by way of illustration and example for purposes of clarity and understanding, those of ordinary skill in the art will realize readily that many changes and modifications may be made thereto without departing form the spirit or scope of the present disclosure.

The invention claimed is:

1. A plurality of sheet materials, each of the plurality of sheet materials comprising:

a first layer including first indicia; and a second layer having a removable portion including second indicia and a single non-removable portion positioned adjacent to the removable portion, the second indicia of the removable portion being (i) the same as the first indicia and (ii) positioned directly over the first indicia such that the removable portion of the second layer directly overlaps the first layer;

wherein the removable portion of the second layer is selectively removable from the first layer;

wherein the non-removable portion of the second layer has a removal instruction thereon that is different than the second indicia of the removable portion of the second layer, the non-removable portion being non-removable from each respective sheet material such that the non-removable portion abuts only one side of the removable portion of the second layer;

wherein the non-removable portion occupies a first surface area and each of the sheet materials occupies a second surface area, the first surface area being less than the second surface area; and wherein the removable portion including the second indicia of each of the plurality of sheet materials is collected and attached on a common sheet or within a single book.

2. The plurality of sheet materials according to claim 1, wherein the first layer of each of the plurality of sheet materials occupies a section of each respective sheet material.

3. The plurality of sheet materials according to claim 1, wherein the first indicia of each of the plurality of sheet materials includes at least one of text, images, letters, words, designs, patterns, visual representations, photographs, logos, symbols, and advertisements or a combination thereof.

4. The plurality of sheet materials according to claim 1, wherein the first indicia of each of the plurality of sheet materials is not discernable when the removable portion of the second layer of each of the plurality of sheet materials is positioned directly on respective first layers of each of the plurality of sheet materials.

5. The plurality of sheet materials according to claim 1, wherein the non-removable portion and the removable portion of each of the plurality of sheet materials are of equal length when each of the plurality of sheet materials is in a first orientation.

6. The plurality of sheet materials according to claim 1, wherein the removal instruction on the non-removable portion of each the plurality of sheet materials triggers a user to remove the removable portion of the second layer from the respective sheet material.

7. The plurality of sheet materials according to claim 1, wherein the removable portion of each the plurality of sheet materials has a third size, the third size being greater than the first size and less than the second size.

8. The plurality of sheet materials according to claim 1, wherein a plurality of removable second layers are positioned directly on the first layer for each of the plurality of sheet materials.

9. The plurality of sheet materials according to claim 1, wherein a barcode is imprinted on the removable portion of the second layer of each of the plurality of sheet materials, the barcode associated with a discount to be redeemed.

10. A plurality of sheet materials, each of the plurality of sheet materials comprising:

a first surface having first indicia; and a plurality of second surfaces each having a removable portion including second indicia and a single non-removable portion positioned adjacent the plurality of second surfaces, each of the removable portions of the plurality of second surfaces positioned directly on the first surface such that the removable portion of each of the plurality of second surfaces directly overlaps the first surface;

wherein the removable portion of each of the plurality of second surfaces is selectively removable from the first surface;

wherein the non-removable portion has a removal instruction thereon that is different than the second indicia of the removable portion of each of the plurality second surfaces;

wherein the non-removable portion occupies a first surface area and each of the sheet materials occupies a second surface area, the first surface area being less than the second surface area; and wherein the removable portion including the second indicia of each of the plurality of sheet materials is collected and attached on a common sheet or within a single book.

11. The plurality of sheet materials according to claim 10, wherein the first indicia of each of the plurality of sheet materials includes at least one of text, images, letters, words, designs, patterns, visual representations, photographs, logos, symbols, and advertisements or a combination thereof.

12. The plurality of sheet materials according to claim 10, wherein the first surface of each of the plurality of sheet materials is not discernable when the removable portion of each of the plurality of second surfaces of each of the plurality of sheet materials is positioned directly on the first surface.

13. The plurality of sheet materials according to claim 10, wherein a barcode is imprinted on the removable portion of each of the plurality of second surfaces for each of the plurality of sheet materials, the barcode associated with a discount to be redeemed.

14. A method of manufacturing a plurality of sheet materials, the method comprising the steps of:

forming a first layer including first indicia; and forming a second layer having a removable portion including second indicia and a single non-removable portion positioned adjacent to the removable portion, the second indicia of the removable portion being (i) the same as the first indicia and (ii) positioned directly over the first indicia such that the removable portion of the second layer directly overlaps the first layer;

wherein the removable portion of the second layer is selectively removable from the first layer;

wherein the non-removable portion has a removal instruction thereon that is different than the second indicia of the removable portion of the second layer, the non-removable portion being non-removable from each respective sheet material such that the non-removable portion abuts only one side of the removable portion of the second layer;

wherein the non-removable portion occupies a first surface area and each of the sheet materials occupies a second surface area, the first surface area being less than the second surface area; and wherein the removable portion including the second indicia of each of the plurality of sheet materials is collected and attached on a common sheet or within a single book.

15. The method according to claim 14, wherein the first indicia of each of the plurality of sheet materials includes at least one of text, images, letters, words, designs, patterns, visual representations, photographs, logos, and advertisements or a combination thereof.

16. The method according to claim 14, wherein the removal instruction on the non-removable portion triggers a user to remove the removable portion of the second layer of each of the plurality of sheet materials.

17. The method according to claim 14, further comprising positioning a plurality of removable second layers on the first layer for each of the plurality of sheet materials, each of the plurality of removable second layers including second indicia.

* * * * *